US009004077B2

(12) United States Patent
Cocuzza

(10) Patent No.: US 9,004,077 B2
(45) Date of Patent: Apr. 14, 2015

(54) PUBIC PATCHES

(71) Applicant: Nicholo Cocuzza, Berkeley Heights, NJ (US)

(72) Inventor: Nicholo Cocuzza, Berkeley Heights, NJ (US)

( * ) Notice: Subject to any disclaimer, the term of this patent is extended or adjusted under 35 U.S.C. 154(b) by 0 days.

(21) Appl. No.: 14/019,840

(22) Filed: Sep. 6, 2013

(65) Prior Publication Data

US 2014/0014129 A1 Jan. 16, 2014

Related U.S. Application Data

(63) Continuation-in-part of application No. 13/403,767, filed on Feb. 23, 2012, now Pat. No. 8,550,094.

(60) Provisional application No. 61/629,972, filed on Dec. 2, 2011.

(51) Int. Cl.

| | |
|---|---|
| ***A41G 3/00*** | (2006.01) |
| ***A41G 5/00*** | (2006.01) |
| ***A45D 44/00*** | (2006.01) |
| ***A41B 9/04*** | (2006.01) |
| ***A41C 3/00*** | (2006.01) |
| ***B32B 9/00*** | (2006.01) |
| ***B32B 33/00*** | (2006.01) |
| ***A61F 15/00*** | (2006.01) |
| *A45D 33/32* | (2006.01) |
| *A45D 34/02* | (2006.01) |
| *A45D 34/00* | (2006.01) |

(52) U.S. Cl.

CPC *A41G 5/00* (2013.01); *A41G 5/004* (2013.01); *A41B 9/04* (2013.01); *A45D 33/32* (2013.01); *A45D 34/02* (2013.01); *A45D 2034/007* (2013.01); *A41G 5/008* (2013.01)

(58) Field of Classification Search

CPC ..... A41B 9/04; A41G 3/00; A41G 3/0008; A41G 3/0025; A41G 3/0041; A41G 3/0066; A41G 3/0075; A41G 5/004; A41G 5/0053; A41G 5/008; A41G 5/0093; A41G 5/00; A45D 33/32; A45D 34/02; A45D 2034/007

USPC ..... 132/201, 200, 216, 105, 273, 275, 53, 132/54, 55, 56, 73, 317–320, 333, 212; 623/15.11; 428/40.1, 41.8, 42.1, 343; 63/12, 14.9, 33; 602/54, 55, 57, 61; D24/189; 2/1, 69, 73, 78.1, 78.2, 109, 2/133, 400, 406, 408, 67, 403; 450/102, 450/103, 104, 81, 108; 604/385.01, 387; 128/830

See application file for complete search history.

(56) References Cited

U.S. PATENT DOCUMENTS

| | | | | |
|---|---|---|---|---|
| 2,534,934 | A * | 12/1950 | Viniegra | 128/846 |
| 3,339,208 | A * | 9/1967 | Marbach | 2/67 |
| 4,465,232 | A * | 8/1984 | Field | 239/36 |

(Continued)

*Primary Examiner* — Vanitha Elgart

(57) ABSTRACT

A pubic patch is provided to apply to the pubic area of a woman, particularly the mons pubis (Pubic Mound) area of the pelvic region. The pubic patch includes an adhesive base with a front side and a back side with decorative material attached to the front side, and the back side attached to human body. The pubic patch may further comprise fragrances and/or illuminating devices. The decorative material may be hairs attached to supporting sheet or LED material. Further, a products kit is provided which contains a plurality of pubic patches. The product kit may include an instruction booklet. A method of using the pubic patch is also provided comprises the steps of selecting a pubic patch and applying the pubic patch to the human surface in the pubic area.

11 Claims, 11 Drawing Sheets

(56) References Cited

U.S. PATENT DOCUMENTS 5,114,419 A * 5/1992 Daniel et al. ..... 604/385.15
5,467,482 A * 11/1995 Crawford, II ..... 2/67
5,483,705 A * 1/1996 DiMatteo ..... 2/466
5,658,270 A * 8/1997 Lichstein ..... 604/387
5,669,395 A * 9/1997 Thompson ..... 128/846
5,832,535 A * 11/1998 Davis ..... 2/1
6,067,663 A * 5/2000 Fernandez ..... 2/406
6,162,457 A * 12/2000 Martz ..... 424/448
6,472,039 B1 * 10/2002 Amen-Ra A ..... 428/42.1
6,490,732 B1 * 12/2002 Spoke ..... 2/67
6,620,143 B1 * 9/2003 Zacharias et al. ..... 604/385.03
6,738,988 B2 * 5/2004 Ruiter et al. ..... 2/400
6,777,356 B2 * 8/2004 Sadato et al. ..... 442/76
6,857,935 B1 * 2/2005 Dohan ..... 450/81
6,921,844 B2 * 7/2005 Cantor ..... 602/41
6,977,106 B2 * 12/2005 Billings ..... 428/40.1
7,089,764 B2 * 8/2006 Brett ..... 63/14.9
7,137,972 B1 * 11/2006 Holberg ..... 604/392
7,291,136 B1 * 11/2007 Drevik et al. ..... 604/385.03
7,368,135 B1 * 5/2008 Anderson ..... 424/725
D580,593 S * 11/2008 Huntington ..... D28/4
7,611,501 B2 * 11/2009 Luizzi ..... 604/385.03
7,857,798 B2 * 12/2010 Buettner ..... 604/385.01
7,913,694 B2 * 3/2011 Clodius-Talmadge ..... 128/830
8,563,800 B2 * 10/2013 Smith ..... 602/56
2001/0012546 A1 * 8/2001 Braun ..... 428/34.1
2002/0151236 A1 * 10/2002 Zolotarsky et al. ..... 442/96
2003/0161983 A1 * 8/2003 Rousselet et al. ..... 428/40.1
2003/0228436 A1 * 12/2003 Ishimura ..... 428/42.3
2004/0033325 A1 * 2/2004 Shea et al. ..... 428/40.1
2004/0163660 A1 * 8/2004 Kellmann ..... 132/201
2005/0013957 A1 * 1/2005 Leschinsky ..... 428/40.1
2005/0235400 A1 * 10/2005 Campbell et al. ..... 2/406
2006/0137078 A1 * 6/2006 Smaczny ..... 2/400
2006/0204702 A1 * 9/2006 Thevenet ..... 428/40.1
2007/0287973 A1 * 12/2007 Cohen et al. ..... 604/385.03
2008/0142020 A1 * 6/2008 Chapin ..... 128/830
2008/0319411 A1 * 12/2008 Mortensen et al. ..... 604/387
2009/0036858 A1 * 2/2009 Van Den Bogart et al. ..... 604/385.03
2009/0062762 A1 * 3/2009 Himbergen et al. ..... 604/385.03
2009/0065008 A1 * 3/2009 Clodius-Talmadge ..... 128/830
2009/0101155 A1 * 4/2009 Young et al. ..... 128/830
2009/0213586 A1 * 8/2009 Peng ..... 362/234
2009/0255547 A1 * 10/2009 Starks et al. ..... 132/201
2010/0152687 A1 * 6/2010 Carlozzi ..... 604/359
2010/0180359 A1 * 7/2010 Andrews ..... 2/69
2011/0030128 A1 * 2/2011 Buettner ..... 2/406
2013/0078421 A1 * 3/2013 Desiderio et al. ..... 428/138

* cited by examiner

PUBIC PATCHES

CROSS REFERENCE TO RELATED APPLICATIONS

This application claims is a continuation-in-part of U.S. patent application Ser. No. 13/403,767 filed on Mar. 5, 2012, the entire contents of which are hereby incorporated by reference, which claims the priority benefit of the U.S. Provisional Patent Application Ser. No. 61/629,972 filed December 2011, the entire contents of which are hereby incorporated by reference.

FIELD OF INVENTION

The invention relates to the field of cosmetics devices. More specifically the invention relates to the field of devices used as an artificial patch for females used on pubic area, particularly the mons pubis (Pubic Mound) area of the pelvic region.

BACKGROUND

Pubic hairs are the hairs around the male and female sexual organs. The pubic hairs are appearing accompanying the onset of the maturity age due to the hormones produced by the human body and are indication of the attainment of puberty by the male and female body. The pubic hair does not perform any necessary function but are sometimes problematic for the body and health of the humans. For example, an ingrown hair is a problem that occurs when a hair curls backward as it grows and re-enters the follicle, continuing to grow beneath the surface of the skin. This is most often accelerated by shaving, as hairs with sharp tips are more likely to become ingrown, and the problem is associated with similar annoyances like razor burn. Most ingrown hairs occur in the pubic area, as hair that is curlier is also more prone to becoming ingrown. Such ingrown hair may become infected and develop into folliculitis. *Staphylococcus aureus* and other bacteria are common causes of these infections, but they may also be caused by fungus or yeast. Ingrown hair related folliculitis is often characterized by redness, inflammation, itchiness and noticeable, sometimes painful bumps on each affected follicle. Though mild cases may improve without treatment, spreading or recurring infections warrant a doctor visit. Treatment options include hydrocortisone cream, a wet compress of white vinegar and doctor-prescribed antibiotic creams. It is also best to avoid shaving the area until the folliculitis has completely cleared. Another common byproduct of an ingrown hair is a pustule, a small but visible collection of pus just under the skin. Pustules caused by ingrown hairs are often similar in appearance to whitehead pimples, although one may be able to see part of the hair emerging from the pus filled area. If the pustule is not severely inflamed or painful, the treatment may relieve the pressure on the pustule by the patient by carefully puncturing it with a needle that has been sterilized with alcohol. After the under-pressure pus drains, patient can carefully clean the area, cover it with an antibiotic ointment and place a small bandage over it to accelerate healing.

Although most ingrown pubic hairs are mild skin problems and can heal on their own without medical intervention, their propensity toward infections can have serious consequences if rare severe cases go untreated. The April 2006 issue of "Men's Health" reports that ingrown hairs may become infected with flesh-eating bacteria that can spread throughout the pubic area. In worst-case scenarios, according to the article, the scrotum may need to be removed and the testicles implanted in pouches located inside the thigh.

Hairs on pubic area are not essential or necessary for human health. Many women do not keep any hairs in the pubic area. The reasons for this include hygiene issues and the requirement of various swimming costumes or lingerie.

The removal of pubic hair by Western women became more common when bathing suits became abbreviated, starting 1945. Changes in lingerie styles have also encouraged the removal of pubic hair. Removal of pubic hair has also been considered to be hygienic for many centuries. However for many men and women, the presence of hair in some form, style, shape lends an added sense of arousal during display of female body during sex. Some females do keep the hairs in some form. This is for the benefit of their male sexual partner. The presence of hairs in some form, style or shape, lends an added sense of arousal during display of female body or during sex.

The "patch" hairs are cut in various popular shapes. Some common shapes are preferred because they retain the hairs in the pubic area which is not visible from the bikini The removal of the hair is commonly called "waxing." Bikini waxing may be classified in different basic styles and shapes which may have different names. American waxing is the removal of only the pubic hair that is exposed by a swimsuit, depending on the style of the swimsuit. For a bikini, it would be hair at the top of the thighs and under the navel. It is also known as a basic bikini wax or a bikini line wax. French waxing leaves a vertical strip in front (sometimes called a landing strip), two to three finger-widths long just above the vulva, and 4 cm (1½ inches) wide. It is also known as a partial Brazilian wax. Hair of the peri-anal area and labia may be removed. Removal of hair from these areas is also known as the Playboy wax or G-waxing. The landing strip wax has become popular with models who must wear garments of an extreme narrowness in the crotch region. Brazilian waxing is the removal of all hair in the pelvic area, front and back, while sometimes leaving a thin strip of hair on the mon pubis. It can be used by those who wear thong bikinis. It is a form of bikini waxing, and involves the complete removal of hair from the buttocks and adjacent to the anus, perineum and vulva (labia majora and mons pubis). If a thin vertical strip of hair is left, it may be called a landing strip. Brazilian waxing is also known as a full Brazilian wax, full Bikini wax, Hollywood wax or the Sphinx The Sphinx variety involves the complete removal of all hair in the pelvic region. The name is derived from that of a naked breed of cat from Canada. The smooth-skinned, hairless Sphynx cat was a genetic oddity discovered in Toronto in 1966. Some salons refer to the Sphynx as the Hollywood.

The various styles of bikini waxing commonly adopted by females are very popular. However, women who wax or shave their pubic hair still face the problems discussed above. Further, to change the style of the hair patch, a woman needs to undergo the complex procedure, which is costly and painful. Hence there is need to provide a cosmetics product that allows women have the hairs in one of a variety of forms which will make them attractive and will act as a sense of arousal during the display of the body and during sexual activity. The disclosed products in this invention are directed to solve one or more problems set forth above and other problems.

BRIEF SUMMARY OF THE INVENTION

One aspect of the present invention provides a pubic hair piece or novelty patch ("Pubic Patch") that can be applied to the pubic area of women's body, namely the mons pubis (Pubic Mound) area. The pubic patch comprises an adhesive base which has two sides, with decorative material attached to the front side, and the back side attached to human body.

The patch can be of different size, shape, and color. The patch can further include other components, such as fragrance and/or illuminating parts.

One aspect of the present invention provides a patch that comprises an adhesive base and decorative material that has a supporting sheet with hair attached thereon.

One aspect of the present invention provides a patch that comprises an adhesive base and a layer of illuminating material. The illuminating material is attached to the front side of the adhesive base. The back side of the adhesive base attaches the patch to human body.

One aspect of the present invention provides a method to use the patch. The method comprises the steps of selecting a patch, and applying the patch to pubic area.

One aspect of the present invention provides a product kit that includes one or a plurality of patches.

One aspect of the present disclosure provides a dance patch. The dance patch includes a pubic patch, wherein said pubic patch includes an adhesive base with a front side and back side, and a first decorative material attached to said front side; wherein said patch having a perimeter, and said patch contacts only a frontal genital area of the woman, and said patch is free of a structure extending from said perimeter beyond the frontal genital area of the woman. The dance patch further includes a genital covering, the genital covering having an adhesive base, wherein the genital covering is configure to exclusively cover within a body area delineated by a side of the pubic patch contacting the genital covering, groins, and anus area.

Other aspects of the present disclosure can be understood by those skilled in the art in light of the description, the claims, and the drawings of the present disclosure.

DETAILED DESCRIPTION

The following descriptions, aspects, embodiments and preferred embodiments are intended as illustrative example only and should not be interpreted as limitation on the scope of the claims. The drawings are for the purpose of demonstrating the invention. The disclosure gave no indication that the drawings were drawn to scale.

Note that, unless clearly stated otherwise, the singular forms of "a", "an", and "the" can mean one or more, depending upon the context in which they are used.

It is the object of this invention to provide women a cosmetic patch that can be applied to the pubic area. It is the further object of the invention to provide a solution which will allow females to maintain the pubic hairs and novelty cosmetics in some form. It is further object of this invention to provide the solution which will allow females to have pubic hairs in a form which is attractive, diverse and sometimes unique and such form also offer variety to their male partners.

It is further object of this invention to provide the solution which will allow females to have pubic hairs in a form which will allow the stimulation or arousal of their male partners by visual means, touch, and means of smell. It is further object of the invention to provide a solution which will allow females to have the pubic hairs in a manner which will not cause any harm to their body like infections, redness, inflammation, itchiness and noticeable pimples, general problems associated with ingrown hairs. As used in this disclosure, the terms "patch," "pubic patch," and "cosmetic patch" are interchangeable, depending upon the context in which they are used.

The present invention further provides a patch that illuminates. The patch has an adhesive base with two sides. An illuminate device can be attached to the front side. The back side is used to attach the patch to the human body.

Figure 1A:
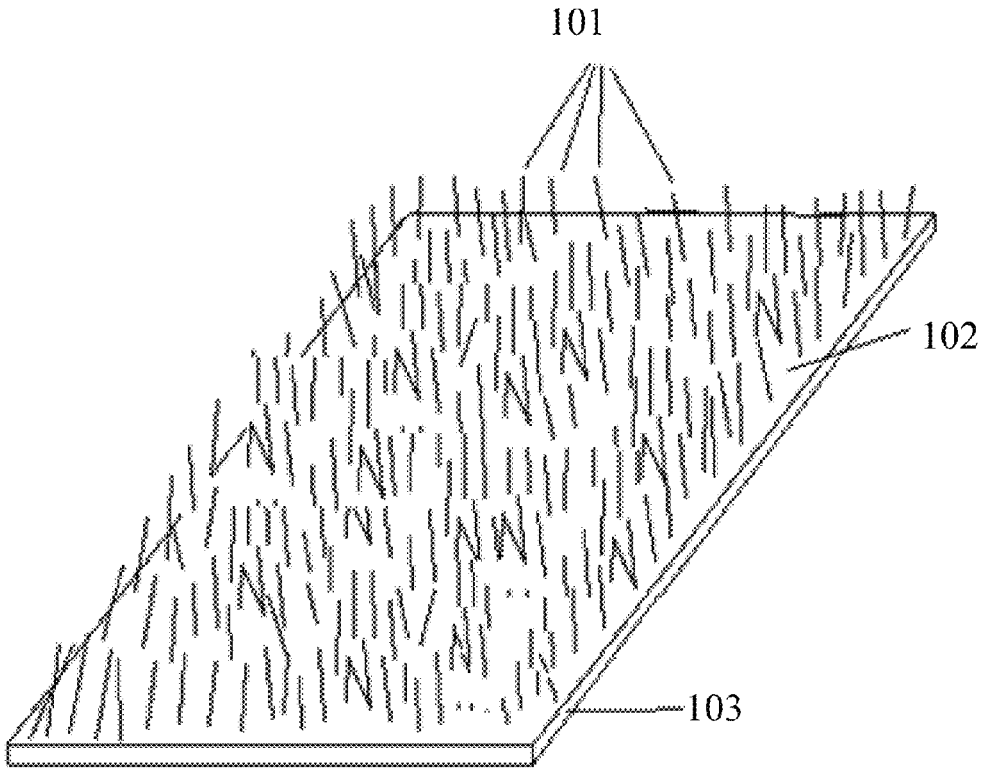
FIG. 1A illustrates an exemplary patch consistent with the disclosed embodiments.

The present invention provides a pubic patch that can be applied to the pubic area of a woman. FIG. 1A shows a front view of the front side of an exemplary pubic patch. A pubic patch has an adhesive base 103 with a front side. Decorative material can be attached to the front side. "Adhesive base," as used in this disclosure, refers to adhesive material that forms a layer in a desired shape and other decorative material can be attached thereon.

In one preferred embodiment as shown in FIG. 1A, the decorative material is a hair or a plurality of hairs 101 that are attached to a supporting sheet 102. "Hair" or "hairs," as used in this invention, are defined as fibre-shaped objects attached to the base or other supporting material. The hairs can be made of a variety of material including but not limited to natural hair, synthetic hair, fur, velvet, plastic, feathers, or any suitable material as used in the art, such as wig. The supporting sheet can be made of a variety of materials including, but not limited to a soft plastic material, cloth, paper, or soft elastic artificial skin, or any other suitable material. Natural hair means any hairs that are derived from human or animal, which may or may not be processed before being implanted into the patch. Synthetic hair means any hair that is man-made. The hairs can be of different colors, such as "Redhead", "Blond", "Brunette", "Fire", "White Blond", "Gray", "Black", "Brown", and any other colors. The hairs can also be of different stiffness, ranging from soft to hard. The hairs can also be in different shape, for example, curly or straight. The hairs can be of different length and cross-section area to length ratio.

In another embodiment, one or a plurality of decorative materials are attached to the front side of the adhesive base. The decorative materials can be made of a variety of materials such as glow-in-the-dark material, crystals, gems, and glass. "Decorative material," as used in this disclosure, is defined as an extrinsic object that is attached to the adhesive base or any other parts of the pubic patch directly or indirectly. "Attach," as used in this disclosure, is defined as to placing an object on the surface or in the interior of the adhesive base or another object. In a preferred embodiment, the decorative material maintains its position on or in the adhesive base for a significant amount of time. In another preferred embodiment, the decorative material is attached to the base permanently.

Figure 1B:
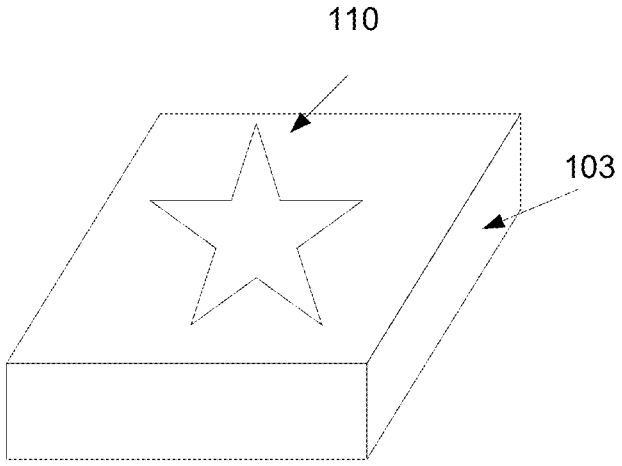
FIG. 1B illustrates an exemplary patch consistent with the disclosed embodiments.

The decorative material may also include any appropriate materials or decorations. For example, the decorative material may include caricatures, symbols, or any other appropriate decoration. As shown in FIG. 1B, the decorative material is a symbol 110. The decorative material may be any appropriate symbol or caricature or other types of decorations, such as hearts, zodiac signs, initials, or animals.

The hairs and other decorative material attached to the adhesive base can be of different size, length, color, and shape. The methods to attach hairs or other decorative material to the adhesive base are well known in the industry.

Figure 2:
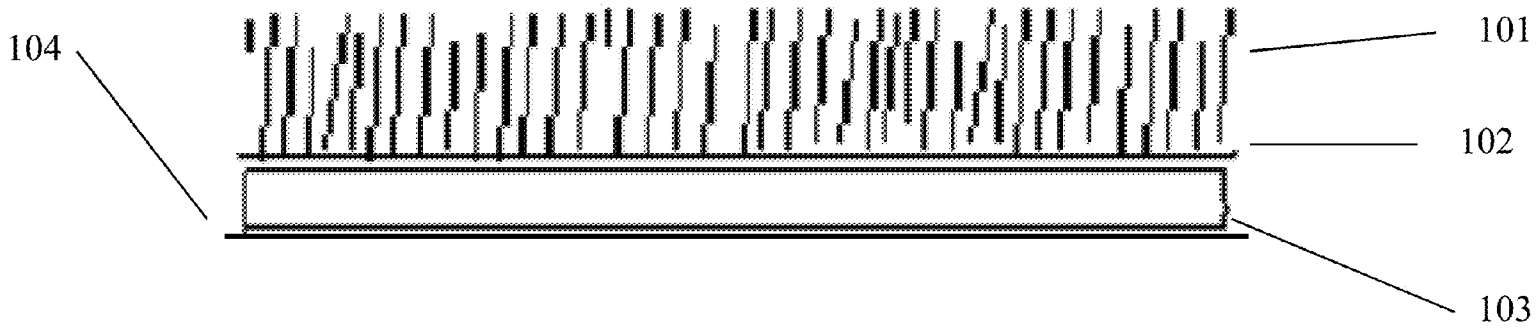
FIG. 2 is the side view of an exemplary patch consistent with the disclosed embodiments.

FIG. 2 is a side view of the pubic patch. As shown in FIG. 2, the hairs 101 are attached to the supporting sheet 102, which is subsequently attached to the front side of the adhesive base 103. A peel-off sheet 104 is attached to the back side of the adhesive base.

The adhesive base can be made of any material, such as the adhesive used medical bandage or female hygiene product. The adhesive attaches the pubic patch onto the pubic area of a woman for desired amount of time. In one embodiment, the adhesive is strong enough so the patch is not inadvertently removed by human movement or interaction between human bodies. In the mean time, the adhesive can also be easily removed as desired. Such adhesive is well known in the art, such as the adhesive used in medical bandage.

In one embodiment, the adhesive base has the same size and shape to decorative material. However, the adhesive base can be of different size and shape to the decorative material. Also, more than one adhesive base can be used.

In another embodiment, the adhesive base and the supporting sheet are infused together.

Figure 3:
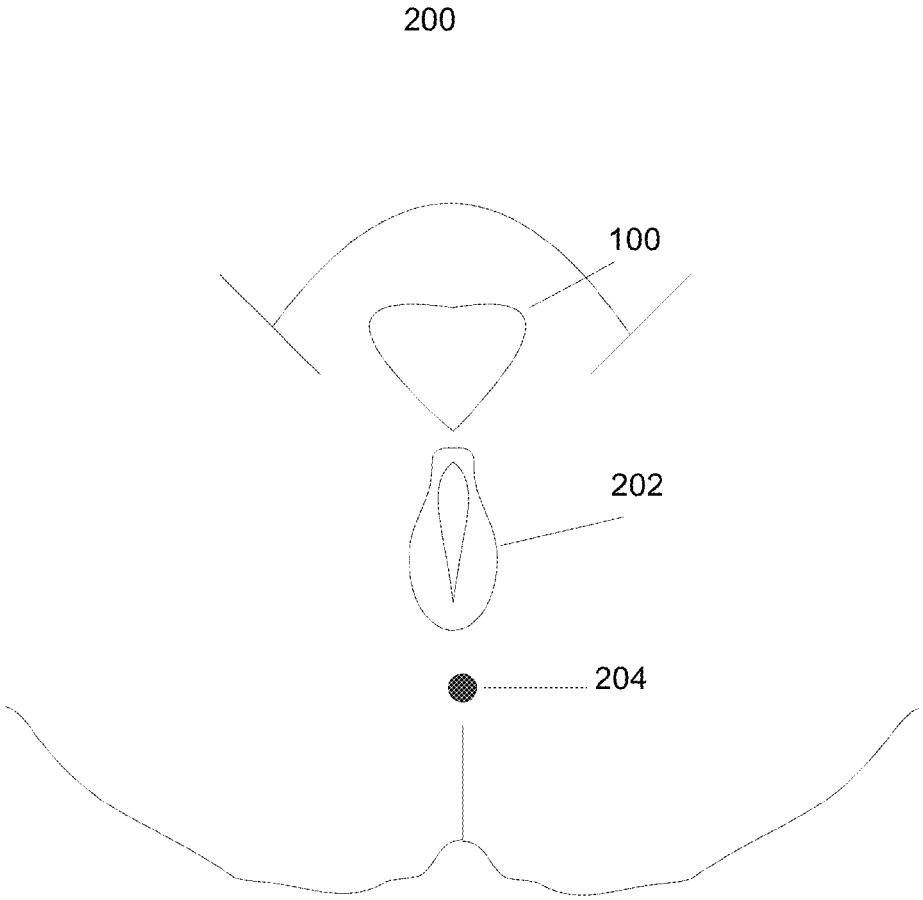
FIG. 3 shows a genital area a woman with a heart shape patch consistent with the disclosed embodiments.
Figure 4A:
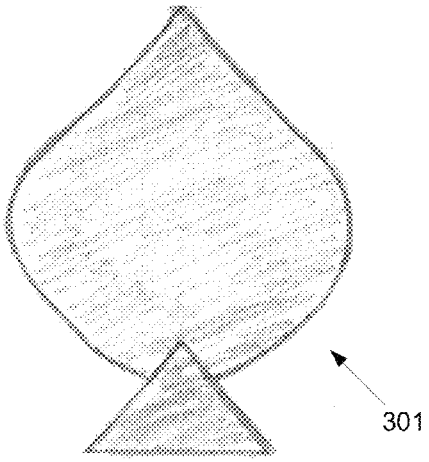
FIGS. 4A to 4H illustrate various shapes of an exemplary patch consistent with the disclosed embodiments.
Figure 4B:
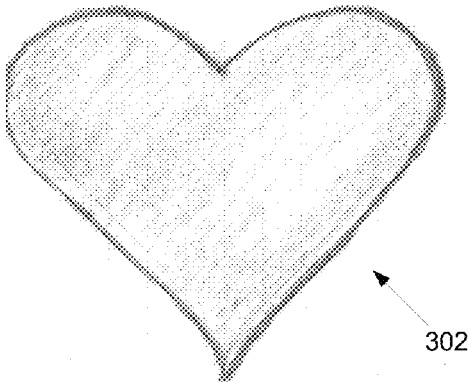
Figure 4C:
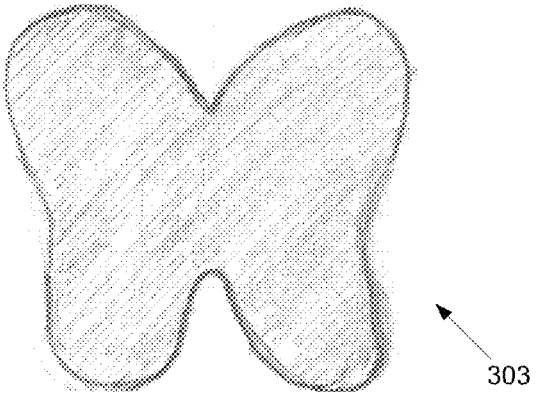
Figure 4D:
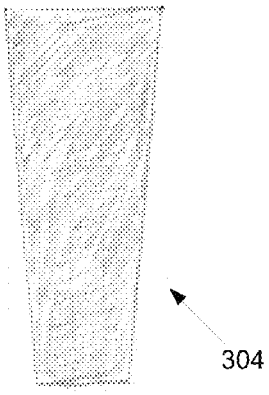
Figure 4E:
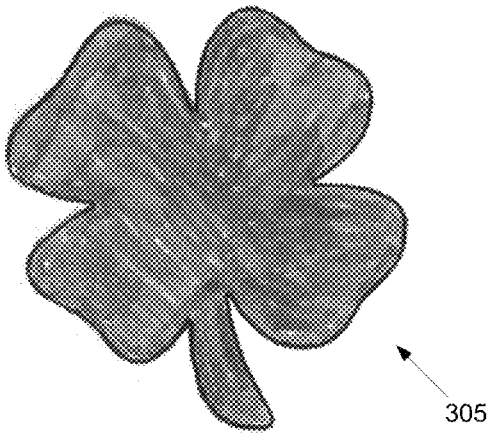
Figure 4F:
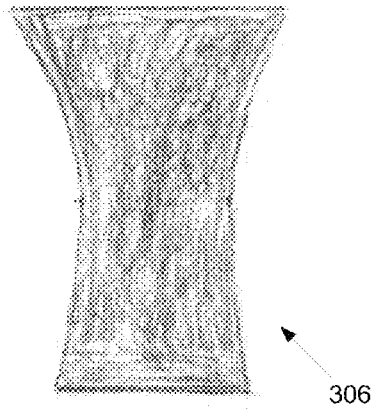
Figure 4G:
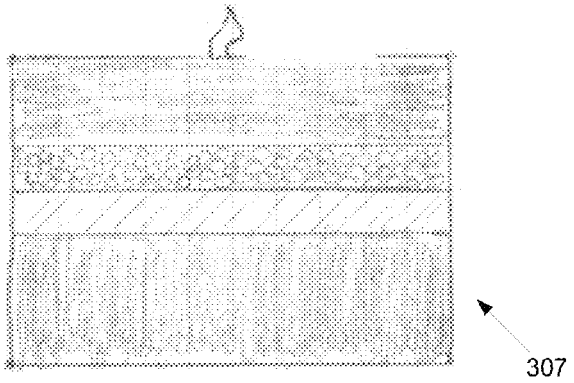
Figure 4H:
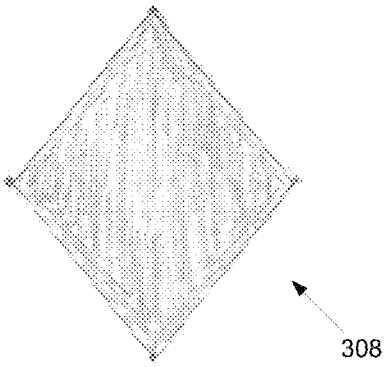

FIG. 3 shows a genital area of a woman 200 with a pubic patch in the shape of heart 100 applied to the pubic area. As shown in FIG. 3, the pubic patch covers the pubic mound area. The genital area includes the external sex organ 202 and anus 204.

The pubic patch can be of a variety of shape, for example, "Heart", "Shamrock", "CloverLeaf", "Tree", "Cake", "Red Lips", "Strawberry", "Butterfly", "Arrow", "Cupid", "Rose", "Bird", "Feather", "Strips", "V", "Egg", "Ball", "Head", "Pie", "Full", "Box", "Spade", "Vegas V", "Candle", "Crest", "Moon", "Cupid", and others. FIGS. 4A to 4H show some embodiments with the shape of spade 301, heart 302, butterfly 303, Vegas strip 304, St. Patrick's Day shape 305, crest 306, birthday cake 307, and diamond 308. However, the embodiment as shown in FIGS. 4A to 4H should not be construed as limitation to the shapes of this invention. A person of ordinary skill in the art can make the pubic patch in any shape.

An exemplary pubic patch consistent with the disclosed embodiment has a perimeter. The pubic patch may be free of a structure extending from the perimeter and reaching beyond the frontal genital area.

The pubic patch can also be of different sizes. In one preferred embodiment, the pubic patch is configured to be covered by the garment a woman wears.

Figure 5A:
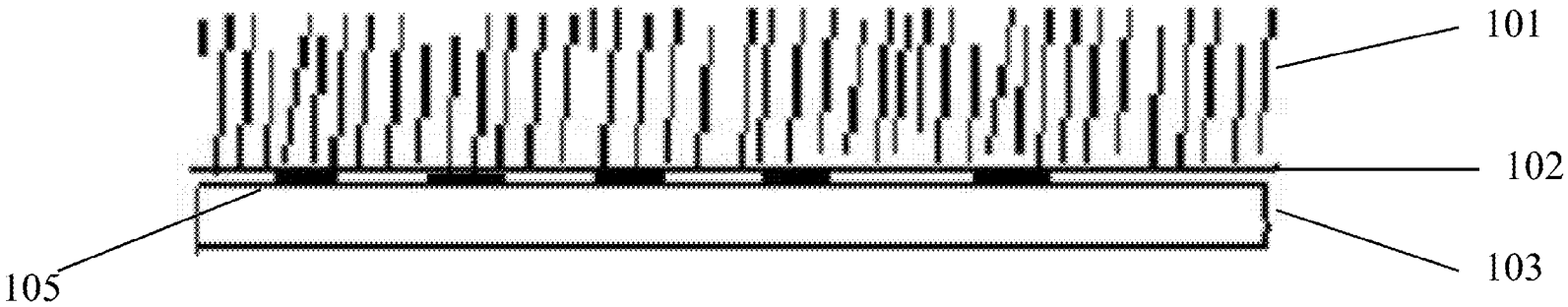
FIG. 5A illustrates the side view of an exemplary patch consistent with the disclosed embodiments.

In another embodiment, a secondary decorative material is attached to the patch. In a preferred embodiment as shown in FIG. 5A, a secondary decorative material is a fragrance 105 that is attached to the pubic patch. The fragrance can be made in different shapes and sizes to be configured into the patch. The fragrance can be directly attached to the patch or be packaged in a pouch and the pouch is attached to the patch. A preferred embodiment is shown in FIG. 5A, in which the fragrance is embedded in between the adhesive base and the supporting sheet of the hair, but the fragrance can be place in any locations on the pubic patch, for example, on the top of the supporting sheet, as long as it is suitable. The method of attaching the fragrances is well known in the art. A person of ordinary skill in the art would choose the fragrance of choice and the release mechanism. Also, a plurality of fragrances can be attached to a patch. In one embodiment, scents like Ylang ylang or oils like Lavender combined with floral oils, patchouli or cedar wood would be used as an aphrodisiac to further enhance the level of stimulation.

Figure 5B:
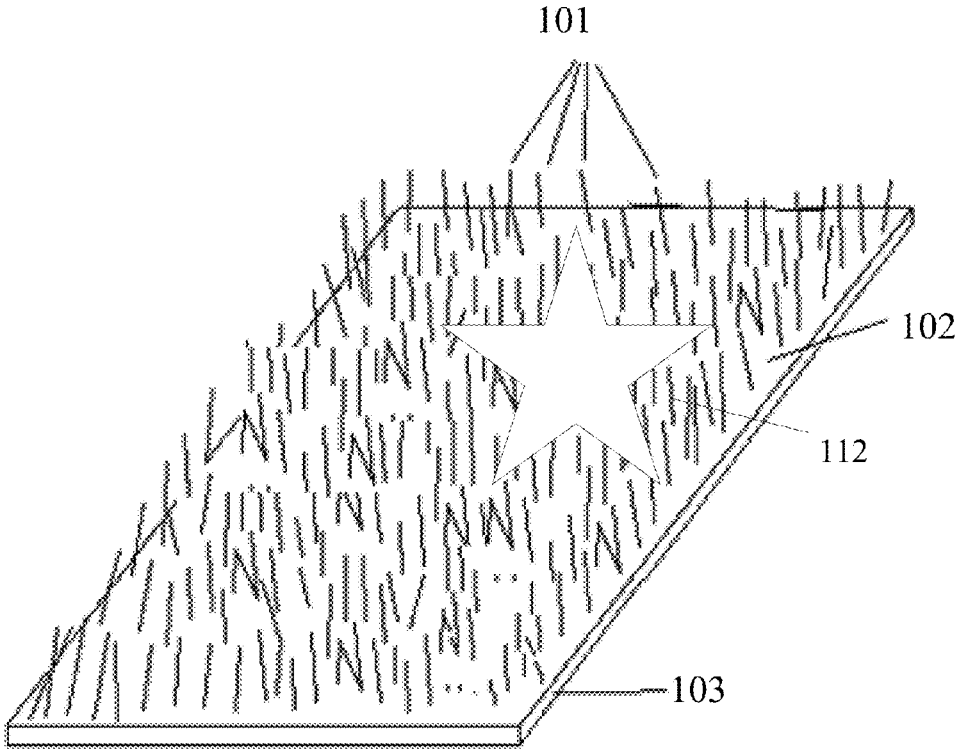
FIG. 5B illustrates an exemplary patch consistent with the disclosed embodiments.

The secondary decorative material may also include any appropriate materials or decorations. For example, the secondary decorative material may include caricatures, symbols, or any other appropriate decoration. As shown in FIG. 5B, the secondary decorative material is a symbol 112. The decorative material may be any appropriate symbol or caricature or other types of decorations, such as hearts, zodiac signs, initials, or animals.

Figure 6:
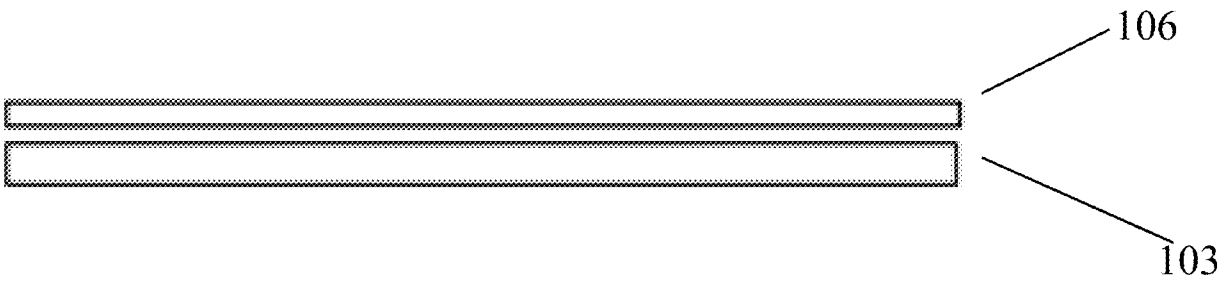
FIG. 6 is the side view of an exemplary patch consistent with the disclosed embodiments.

In one embodiment as shown in FIG. 6, the pubic patch comprises an illuminating device 106 and an adhesive base 103 with two sides. In one preferred embodiment, the illuminating device can be made of light-emitting diode (LED) so as to light in different colors. The device may have a "glow-in-the-dark" feature which would glow in the dark. This will be made possible with a phosphor that is energized by normal light and that has a very long persistence. The material may be used for the illuminating purpose include, but is not limited to, Zinc Sulfide, Strontium Aluminate. The materials and the methods of making the illuminating device are well known in the art. The illuminating device can be of any shape and size as long as it is suitable to be placed on the pubic patch.

The present invention also provides a product kit. The kit contains one or a plurality of pubic patches. The pubic patches within the same kit can be of same shape and/or size. They can also be of different shape, style, and/or size. In one embodiment, an instruction booklet is provided as to how to use the pubic patch.

The present invention also provides a method to use the pubic patch. The method comprises the steps of selecting a patch and applying the patch to the pubic area by contacting the adhesive to human surface. The patch can be applied any location in the pubic area. In one embodiment, the patch is applied to the woman's vulva area, particularly the area known as the "Venus Mould" or the Mons Pubis. In another embodiment, the patch selected further comprises a peel off sheet. The method of using a patch with peel off sheet comprises the steps of selecting a patch, removing the peel off sheet, and applying the patch to the pubic area by contacting the adhesive to human surface.

Figure 7:
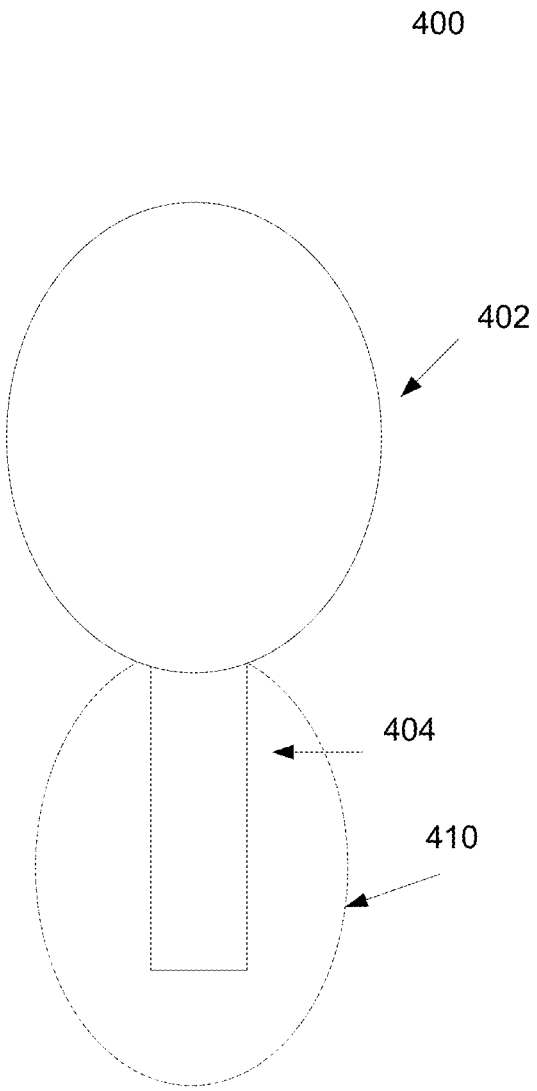
FIG. 7 illustrates an exemplary dance patch consistent with the disclosed embodiments.

FIG. 7 illustrates an exemplary dance patch 400 consistent with the disclosed embodiments. As shown in FIG. 7, the dance patch 400 includes a pubic patch 402 and a genital covering 404. The pubic patch 402 may have similar structure as the pubic patch 100 described in the foregoing disclosure. The genital covering 404 may be configured to cover the genitalia of a user. In certain embodiment, the genital covering 404 may be configured to cover the external sex organ, including vulva. The pubic patch 402 portion of the dance patch 400 may take any appropriate shape. The genital covering 404 of the dance patch 400 may be in a shape of a strip. The genital covering 404 may also take any other appropriate shape.

The genital covering 404 may have similar structure as to the pubic patch 402. That is, the genital covering 404 may have an adhesive base and a first decorative material attached to the adhesive base. The first decorative material on the covering 404 may or may not be the same as the first decorative material on the pubic patch 402. The genital covering 404 may also have a different structure to the pubic patch 402. For example, the genital covering 404 may have an adhesive base but may not include a first decorative material.

Figure 8:
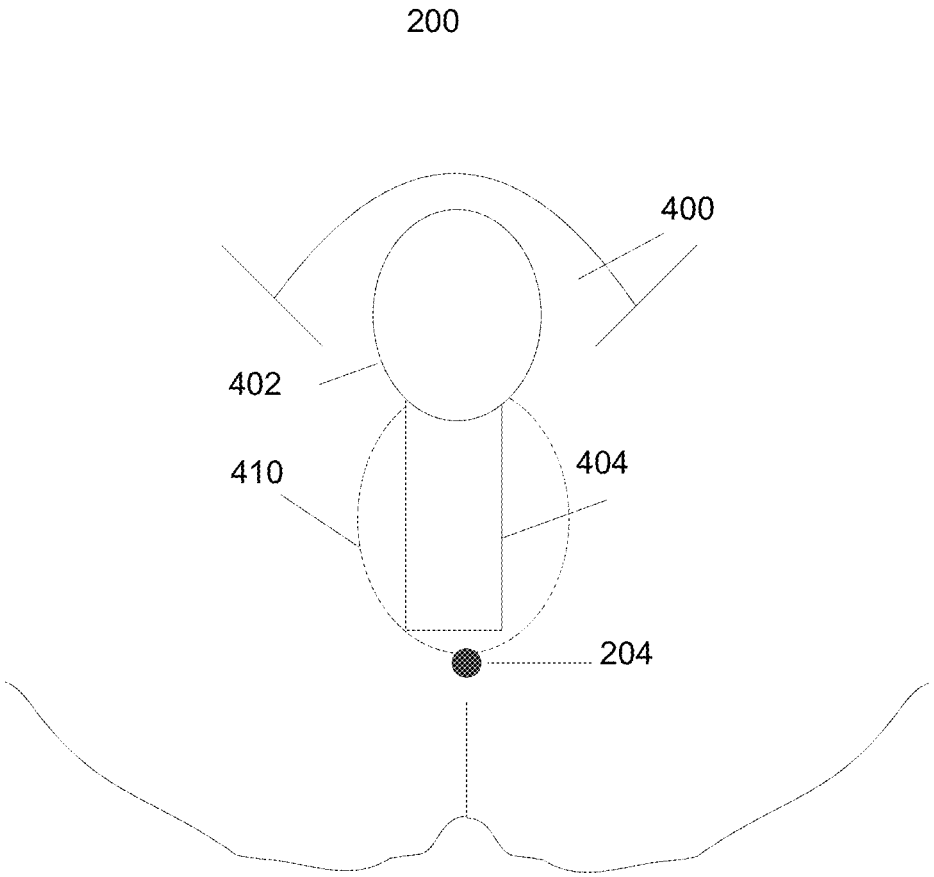
FIG. 8 illustrates an exemplary dance patch consistent with the disclosed embodiments as applied to a woman.

In certain embodiments, the genital covering 404 may be configured to cover exclusively the vulva area. As shown in FIG. 7, the adhesive and the first decorative material of the genital covering 404 may be confined within a perimeter 410. As shown in FIG. 8, the, the pubic patch 402 of the dance patch 400 covers the pubic mound and the genital covering 404 covers the external sex organ of a woman 200. The perimeter 410 may be confined within an area delineated by a side of the genital covering 404 contacting the pubic patch 402 anteriorly, the anus area posteriorly, and the groins laterally. Comparing to FIG. 3, the genital covering 404 covers the external sex organ 202 (not shown in FIG. 8).

The dance patch 400 may be used by exotic dancers to cover the external sex organ. In certain jurisdictions, the exotic dancers may be prohibited from exposing their genitals. An exotic dancer wearing the dance patch 400 with the genital covering 404 may comply with the local law with respect to exposure of genitalia.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

It should be noted that the methods of making the present invention, namely, the methods of attaching different part of the invention together such as attaching the hairs to the supporting sheet, attaching decorative material to the adhesive, and attaching the LED to the adhesive, are well known in the art. A person of ordinary skill in the art is able to select the method to make the present invention.

What is claimed is:

1. A pubic patch that is applied to a pubic area of a woman's body, comprising:

an adhesive base with a front side and back side;

a plurality of hair attached to said front side; and a decorative symbol attached to said front side, said patch having a perimeter, wherein:

said patch is configured to contact and cover exclusively a Mons pubis of the woman and said patch is free of a structure extending from said perimeter beyond the Mons pubis of the woman.

2. The pubic patch according to claim 1, wherein said hair comprising:

a supporting sheet with a first side and a second side, said hair being attached to said first side, wherein:

said second side of said supporting sheet is attached to said front side of said adhesive base.

3. The pubic patch according to claim 1, further comprising:

a fragrance attached to said patch.

4. The pubic patch according to claim 3, wherein:

said fragrance is embedded between said adhesive base and said hair.

5. The pubic patch according to claim 3, wherein:

said fragrance is selected from the group consisting of Ylang ylang, Lavender combined with floral oils, patchouli and cedar wood.

6. The pubic patch according to claim 1, further comprising:

illuminating material attached to said patch.

7. The pubic patch according to claim 6, wherein:

said illuminating material is a LED.

8. The pubic patch according to claim 6, wherein:

said illuminating material is capable of glowing in the dark.

9. The pubic patch according to claim 7, wherein:

said illuminating material is selected from the group consisting of Zinc Sulfide and Strontium Aluminate.

10. A method to use a pubic patch by a woman, said pubic patch comprising an adhesive base with a front side and back side, a plurality of hair attached to said front side, and a decorative symbol attached to said front side, and said patch having a perimeter, wherein said patch is configured to contact and cover exclusively a Mons pubis of the woman and said patch is free of a structure extending from said perimeter beyond the Mons pubis of the woman, comprising:

selecting said pubic patch; and applying said pubic patch by contacting said back side of said adhesive base to a human skin of the Mons pubis area.

11. The method to use the pubic patch of claim 10, wherein said patch further comprising a peel-off sheet attached to the back side of the adhesive base, comprising:

selecting said patch;

removing said peel-off sheet; and applying said patch by contacting said back side of said adhesive base to the skin of the Mons pubis area of the woman.

* * * * *